United States Patent [19]

Gaylord, Jr. et al.

[11] Patent Number: 4,944,318

[45] Date of Patent: Jul. 31, 1990

[54] NAIL POLISH APPLICATOR

[76] Inventors: Thurmond O. Gaylord, Jr.; Thurmond O. Gaylord, Sr., both of 455 Uvalde, Houston, Tex. 77015

[21] Appl. No.: 268,280

[22] Filed: Nov. 7, 1988

[51] Int. Cl.[5] ..... A45D 29/00

[52] U.S. Cl. ..... 132/73; 132/320; 401/126

[58] Field of Search ..... 132/73, 73.5, 75.3, 132/75.4, 75.6, 76.4, 320; 401/126, 130

[56] References Cited

U.S. PATENT DOCUMENTS

| | | | |
|---|---|---|---|
| 2,242,016 | 5/1941 | McKinney, Jr. | 132/73 |
| 2,559,825 | 7/1951 | McKinney, Jr. | 132/73 |
| 2,568,328 | 9/1951 | Elby | 132/73 |
| 3,226,754 | 1/1966 | Brittain | 401/130 |
| 3,837,749 | 9/1974 | Spatz | 401/130 |
| 3,951,157 | 4/1976 | Idec | 132/320 |
| 4,213,473 | 7/1980 | Gueret et al. | 401/130 |

*Primary Examiner*—Gene Mancene
*Assistant Examiner*—Michael Lynch
*Attorney, Agent, or Firm*—Jerry T. Kearns

[57] ABSTRACT

A nail polish applicator has an elongated shank having a bottle cap for engagement with a nail polish bottle at one end and a rectangular foam rubber sponge nail polish applicator at an opposite end. In a first embodiment, a rectangular scraping plate is secured overlying one side face of the rectangular sponge and has a sharpened scraping edge extending slightly beyond a bottom surface of the sponge. The scraping edge is utilized for scraping polish from nail cuticles, stirring polish within the bottle and scraping polish from the side walls of the polish bottle. In a second embodiment, the scraping plate is secured on a bottom surface of the sponge and has a concave bottom surface, forming spaced parallel side scraping edges.

1 Claim, 2 Drawing Sheets

NAIL POLISH APPLICATOR

BACKGROUND OF THE INVENTION

1. Field of the Invention

The present invention relates to nail polish applicators, and more particularly pertains to a new and improved nail polish applicator which utilizes a foam sponge rubber applicator in combination with a rigid scraping plate to apply nail polish more efficiently and in a smoother fashion than could be achieved utilizing conventional brush type applicators. Conventional brush type applicators do not readily absorb and hold a quantity of nail polish. Such brush applicators have a tendency to drip and also to leave brush marks on the polished nail surface. Additionally, when painting one's fingernails, there is a tendency to apply a small amount of polish to the nail cuticle in order to apply polish to the entire exposed surface of the nail. In order to allow quick removal of such excess polish, the present invention utilizes a rigid scraping plate secured to the sponge applicator. The scraping plate additionally allows remaining polish in a nearly empty bottle to be scraped from the bottle side walls and thus prevents waste.

2. Description of the Prior Art

Various types of nail polish and cosmetics applicators are known in the prior art. A typical example of such an applicator is to be found in U.S. Pat. No. 3,226,754, which issued to R. Brittain on Jan. 4, 1966. This patent discloses a sponge rubber type applicator for cosmetics which has a central hollow cylinder for insertion of the index finger of a user. The cylindrical sponge applicator is then wiped against the body surface on which the cosmetic is to be applied. U.S. Pat. No. 3,837,749, which issued to W. Spatz on Sept. 24, 1974, discloses a sponge type applicator secured on an elongated shank member and utilized to absorb and apply cosmetics. U.S. Pat. No. 3,951,157, which issued to E. Idec on Apr. 20, 1976, discloses an applicator for dispensing powdered cosmetics which may utilize a cylindrical tubular sponge secured on an end of an elongated shank member. U.S. Pat. No. 4,213,472, which issued to J. Gueret et al on July 22, 1980, discloses a sponge type applicator for cosmetics which is secured to an end portion of a sleeve adapted for insertion of an individual's index finger.

While the above mentioned devices are suited for their intended usage, none of these devices disclose a nail polish applicator which utilizes a rectangular foam rubber sponge applicator. Additionally, none of these prior art devices disclose a cosmetic or nail polish applicator which includes a rigid scraping plate secured to a side or bottom face of a rectangular sponge applicator. Inasmuch as the art is relatively crowded with respect to these various types of nail polish applicators, it can be appreciated that there is a continuing need for and interest in improvements to such nail polish applicators, and in this respect, the present invention addresses this need and interest.

SUMMARY OF THE INVENTION

In view of the foregoing disadvantages inherent in the known types of nail polish applicators now present in the prior art, the present invention provides an improved nail polish applicator. As such, the general purpose of the present invention, which will be described subsequently in greater detail, is to provide a new and improved nail polish applicator which has all the advantages of the prior art nail polish applicators and none of the disadvantages.

To attain this, representative embodiments of the concepts of the present invention are illustrated in the drawings and make use of an elongated shank having a bottle cap for engagement with a nail polish bottle at one end and a rectangular foam rubber sponge nail polish applicator at an opposite end. In a first embodiment, a rectangular scraping plate is secured overlying one side face of the rectangular sponge and has a sharpened scraping edge extending slightly beyond a bottom surface of the sponge. The scraping edge is utilized for scraping polish from nail cuticles, stirring polish within the bottle and scraping polish from the side walls of the polish bottle. In a second embodiment, the scraping plate is secured on a bottom surface of the sponge and has a concave bottom surface, forming spaced parallel side scraping edges.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminologY employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved nail polish applicator which has all the advantages of the prior art nail polish applicators and none of the disadvantages.

It is another object of the present invention to provide a new and improved nail polish applicator which may be easily and efficiently manufactured ad marketed.

It is a further object of the present invention to provide a new and improved nail polish applicator which is of a durable and reliable construction.

An even further object of the present invention is to provide a new and improved nail polish applicator which is susceptible of a low cost of manufacture with regard to both materials and labor, and which accordingly is then susceptible of low prices of sale to the consuming public, thereby making such nail polish applicators economically available to the buying public.

Still yet another object of the present invention is to provide a new and improved nail polish applicator which provides in the apparatuses and methods of the prior art some of the advantages thereof, while simultaneously overcoming some of the disadvantages normally associated therewith.

Still another object of the present invention is to provide a new and improved nail polish applicator which utilizes a rectangular sponge rubber applicator to absorb and smoothly apply a quantity of nail polish.

Yet another object of the present invention is to provide a new and improved nail polish applicator with an attached scraping plate to allow removal of excess polish from nail cuticles.

Even still another object of the present invention is to provide a new and improved nail polish applicator with an attached scraping plate to allow remaining polish to be collected from the side walls of a nearly empty polish bottle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
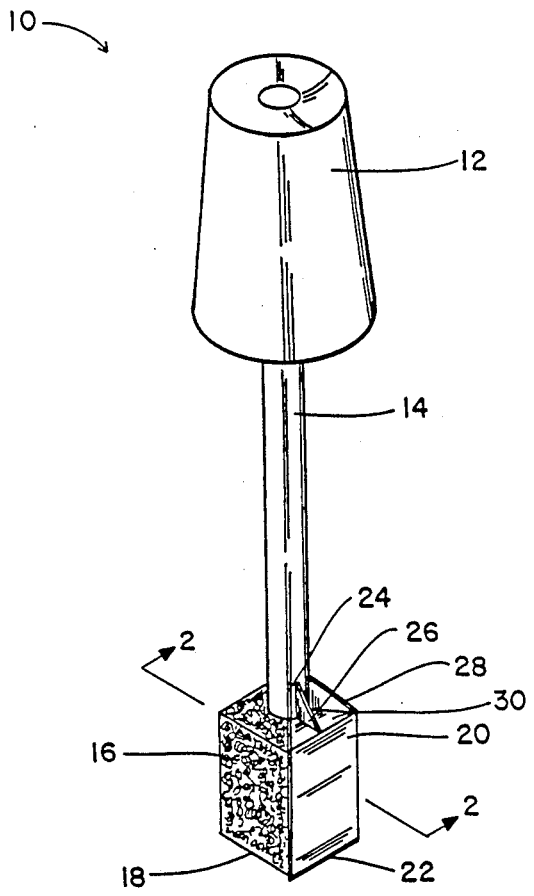
FIG. 1 is a perspective view of the nail polish applicator according to the first embodiment of the present invention.

With reference now to the drawings, and in particular to FIG. 1 thereof, a new and improved nail polish applicator embodying the principles and concepts of the present invention and generally designated by the reference numeral 10 will be described.

More specifically, it will be noted that the first embodiment 10 of the invention includes a bottle cap 12 of a conventional construction adapted for engagement with the neck portion of a nail polish bottle. The cap 12 may be of the frictional snap on type or may have internal threads. An elongated shank member 14 has an upper end secured centrally within the cap member 12 and a bottom opposite end secured to a rectangular sponge rubber applicator 16. A rectangular scraping plate 20 has a sharpened bottom edge 22 which extends slightly beyond the bottom surface 18 of the applicator 16. A perpendicular flange 30 is secured adjacent a top edge of the scraping plate 20 and partially overlies an upper surface of the applicator 16 and is secured to the elongated shank member 14. A plurality of triangular brace struts 24, 26, and 28 enhance the securement of the flange 30 to the shank 14. The brace struts 24, 26 and 28 are circumferentially arrayed about a portion of the circumference of the shank 14. In use, the side face of the rectangular applicator 16, opposite the scraping plate 20 is utilized to applY a smooth coat of nail polish to a fingernail. Additionally, the bottom surface 18 may also be employed for this purpose. In order to push back the nail cuticle, or to remove excess polish therefrom, the scraping edge 22 of the plate 20 is utilized. AdditionallY, the scraping edge 22 may be utilized to collect remaining polish from the side walls of a nearly empty nail polish bottle.

Figure 2:
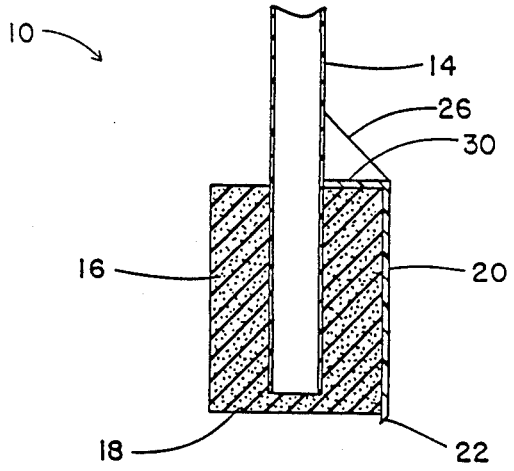
FIG. 2 is a longitudinal cross sectional view, illustrating the constructional details of the applicator and attached scraping plate according to the first embodiment of the present invention.

As shown in the longitudinal cross sectional view of FIG. 2, the scraping edge 22 of the plate 20 is chamfered or sharpened and projects slightly beyond the bottom surface 18 of the applicator 16. The plate 20 and flange 30 are preferably formed from a thin rigid plastic material.

Figure 3:
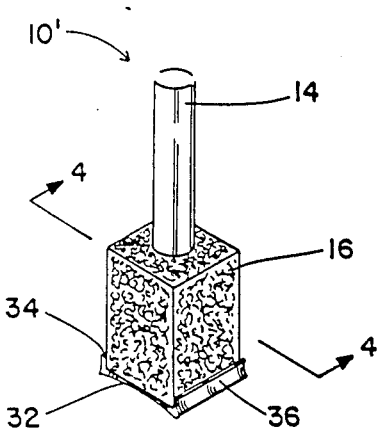
FIG. 3 illustrates a modified form of scraping plate according to a second embodiment of the present invention.
Figure 4:
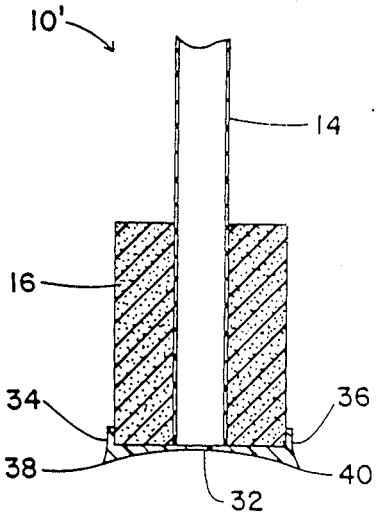
FIG. 4 provides a longitudinal cross sectional view, taken along line 4—4 of FIG. 3.

FIG. 3 provides a perspective view illustrating a slightly modified form of scraping plate, which is secured to the bottom surface of the applicator 16. The scraping plate has an arcuate concave bottom surface 32 and generally parallel upwardly extending side walls 34 and 36 which partially overlie opposite side faces of the rectangular sponge applicator 16. As shown in the longitudinal cross sectional view of FIG. 4, the opposite side faces 34 and 36 are curved or flared outwardly and intersect the arcuate concave bottom surface 32 to form parallel sharpened scraping edges 38 and 40. The shank 14 extends entirely through the sponge rubber applicator 16 and terminates flush with the bottom surface thereof. The bottom end of the shank member 14 is secured to the scraping plate. Additionally, to provide an enhanced securement, suitable adhesives may be employed The location of the scraping plate on the bottom surface of the sponge 16 alloWs all side faces of the sponge to be utilized for applying polish.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A nail polish applicator, comprising:

an elongated shank member;

a bottle cap on one end of said shank member;

a rectangular sponge secured on an opposite end of said shank member;

said shank member extending through a central passage in said sponge and having a bottom end terminating flush with a bottom surface of said sponge;

a generally rectangular plate overlying and completely covering said bottom surface of said sponge, said plate centrally secured to said bottom end of said shank member;

said plate having a concave bottom surface;

said plate having a pair of upwardly extending side walls partially overlying opposite side faces of said sponge; and said side walls of said plate having outwardly curved bottom edges, intersecting said bottom surface and forming a pair of parallel opposed scraping edges.

* * * * *